United States Patent [19]

McGinn

[11] 4,337,753

[45] Jul. 6, 1982

[54] STOVE HAVING NONESCAPING SMOKE

[75] Inventor: Terrance E. McGinn, Sellersville, Pa.

[73] Assignee: Penn-Field Stove, Inc., Sellersville, Pa.

[21] Appl. No.: 181,781

[22] Filed: Aug. 27, 1980

[51] Int. Cl.[3] ..... F23L 3/00

[52] U.S. Cl. ..... 126/287; 126/289; 126/66

[58] Field of Search ..... 126/61, 66, 79, 69, 126/75, 83, 287, 286, 77, 285 R, 289, 290

[56] References Cited

U.S. PATENT DOCUMENTS

| | | | |
|---|---|---|---|
| 547,452 | 10/1895 | Ridgway | 126/287 |
| 1,655,055 | 1/1928 | Glass | 126/287 |
| 2,352,057 | 6/1944 | Wingert | 126/287 |
| 2,444,402 | 6/1948 | Klein | 126/287 |

FOREIGN PATENT DOCUMENTS

| | | | |
|---|---|---|---|
| 9672 | 1/1895 | Switzerland | 126/287 |

*Primary Examiner*—James C. Yeung

*Attorney, Agent, or Firm*—Raymond Underwood

[57] ABSTRACT

A wood or coal burning stove has a main opening from the fire box into a heating chamber at a remote location from the flue exit from that chamber so the combustion gases must move around within the chamber before escaping and an auxiliary opening from the fire box directly to the flue exit, there being a movable closure which closes the auxiliary opening when the front door is closed and which is operatively connected to the front door so it is opened when the front door is opened.

1 Claim, 5 Drawing Figures

STOVE HAVING NONESCAPING SMOKE

This invention relates to stoves and particularly to wood and coal burning stoves which have their principal use in residential homes and have other like uses.

Stoves for this general purpose have been used for centuries because they supply warmth to a room, they tend to create a comfortable, cozy atmosphere and are simple to operate. Wood and coal have always been relatively freely available and at a comparatively cheap cost. In this respect they have avoided the complexity and high cost of fuel oil heating systems which require a large oil supply tank, an intricate oil burner and a source of electricity.

As fuel oil is very expensive at the present time there is a growing return trend to room size wood and coal burning stoves. Because they are located within a living room, for instance, it is important that they do not emit any smoke into the room. There has to be an opening in the stove casing to the fire box, of course, so that fuel can be placed in the stove for burning. This access opening, in almost all instances, is closeable by doors so that smoke will not come out in the room.

It has been found by experience that, very often, when the door is opened a puff or more of smoke will come out in the room. The opening movement of the door tends to draw out with it some of the smoke from the fire box and this is especially likely to occur if the front opening is large relative to the size of the fire box. The opening of a large front door tends to minimize the draft which has been moving through the stove and consequently some smoke moves out in the room.

Although this smoking problem has been recognized no satisfactory solution to it has been offered in the past. One way of stopping or at least minimizing the smoke discharge problem is disclosed and claimed in my copending patent application Ser. No. 178,093 filed on Aug. 14, 1980 having the title Anti-Smoke Emitting Stove. Its feature is the provision of movable closures for the draft air inlet openings which are automatically closed when the front door is opened. This shuts off the normal draft through the stove so that the smoke in the fire box is drawn up the flue and chimney. When the front door is closed the closures are automatically opened.

The present invention provides another means for insuring that the fire box smoke is drawn into the flue rather than escape through the front door opening, especially if the opening is quite large. The present invention is here shown as applied to the same basic stove of my earlier application and the disclosure of that application is therefore incorporated in the present application by this reference. It will be clear that the structure of the present invention can be applied to other stove designs.

Figure 1:
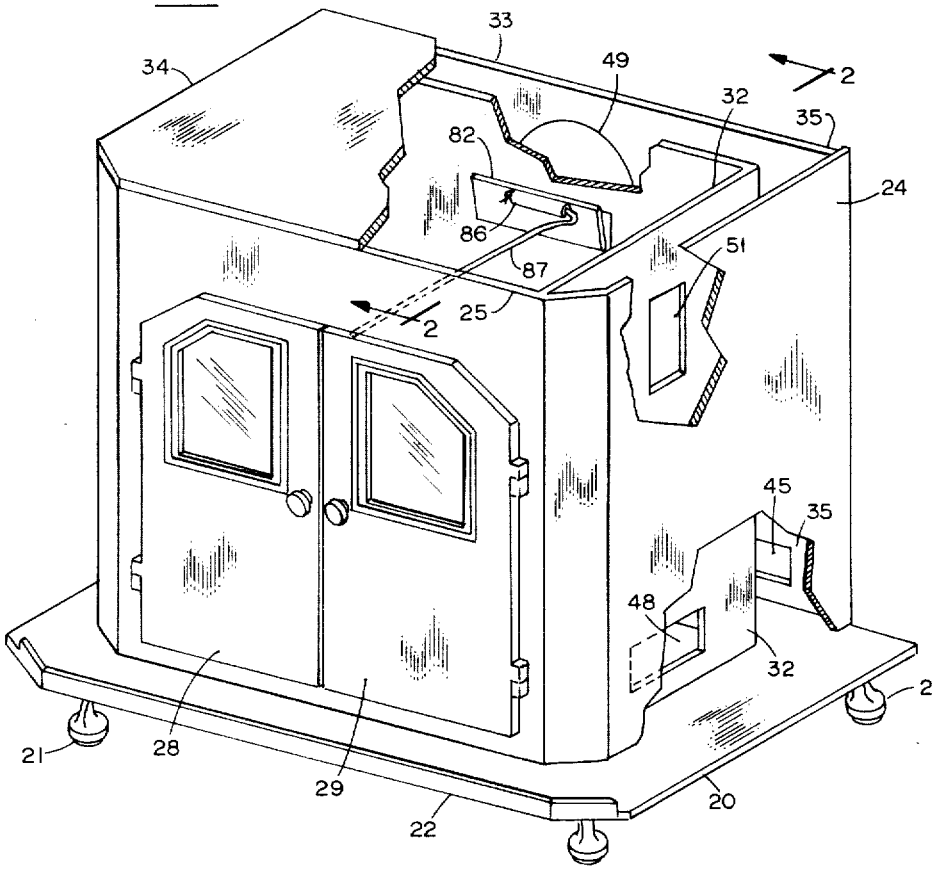
Figure 2:
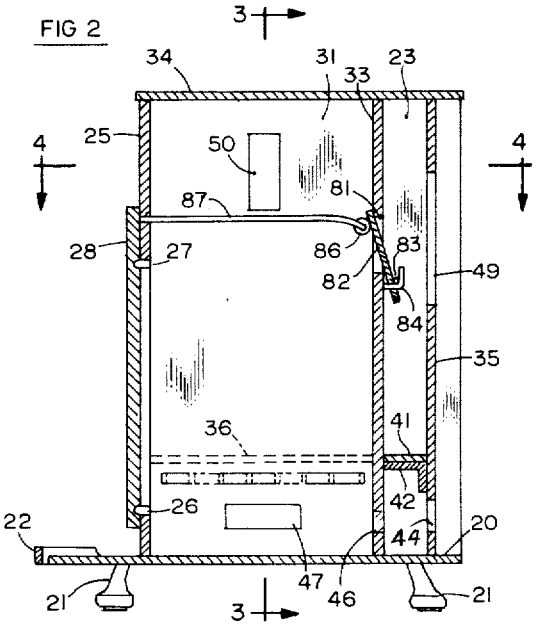
Figure 3:
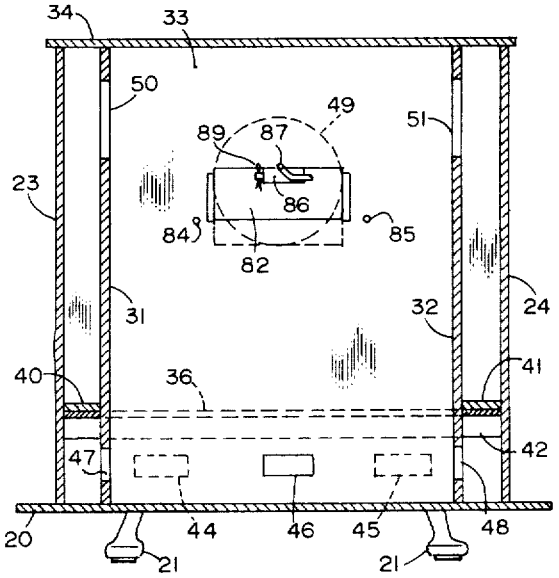
Figure 4:
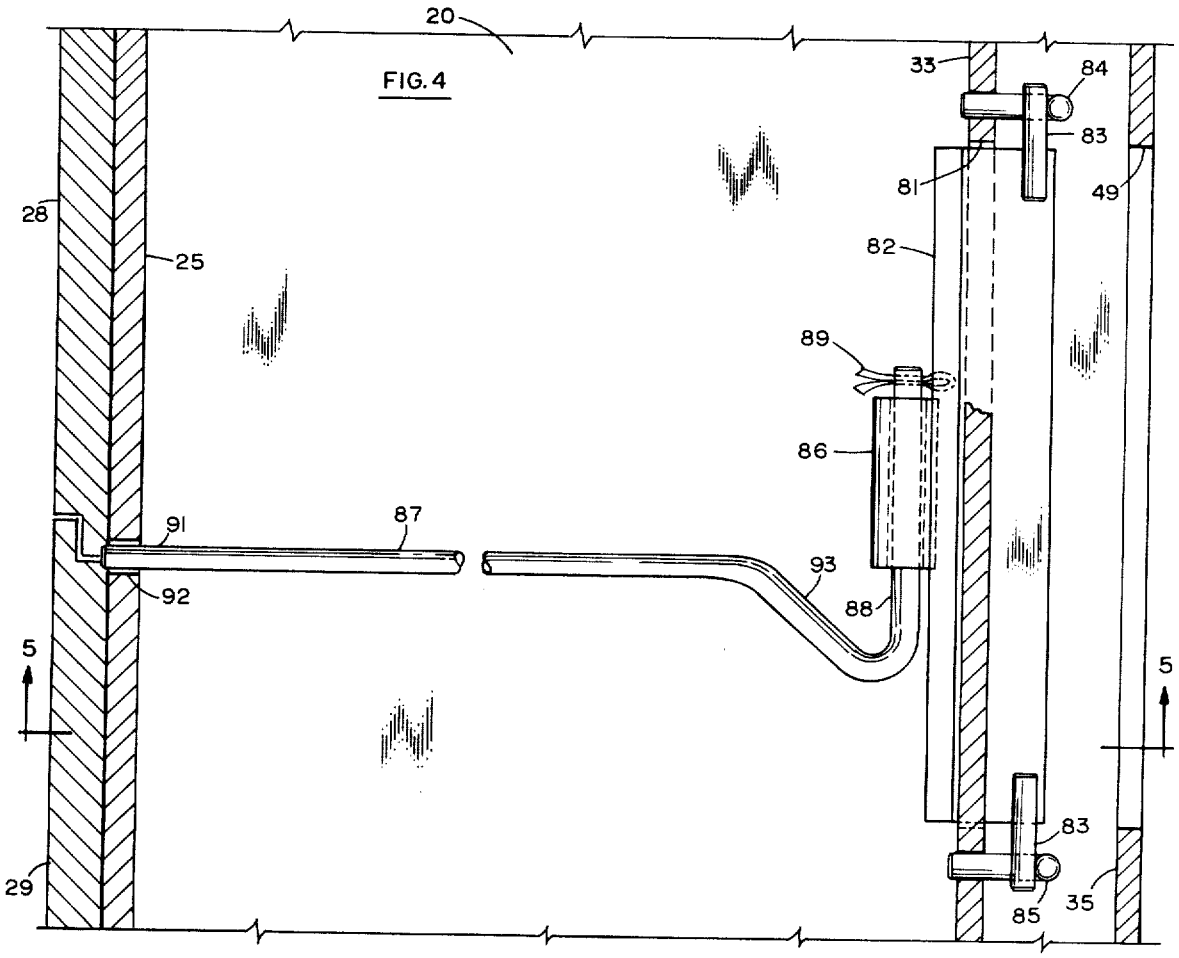
Figure 5:
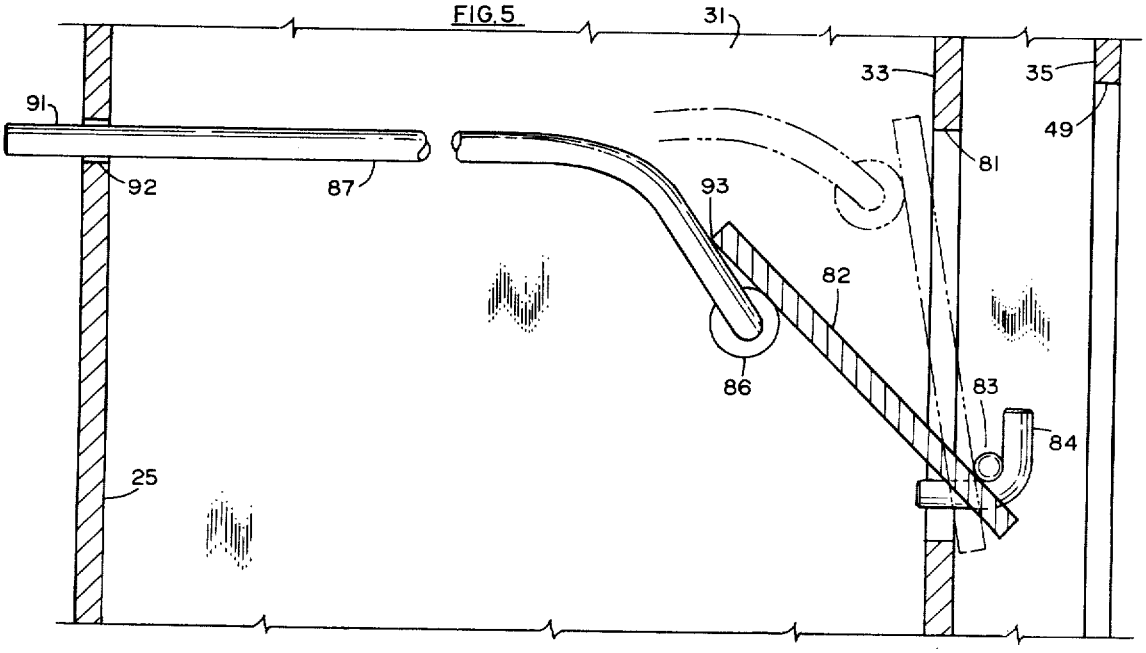

A preferred embodiment of the invention is illustrated in the accompanying drawings in which:

FIG. 1 is a perspective view of the stove, parts being broken away to show the internal structure, FIG. 2 is a vertical sectional view on the line 2—2 of FIG. 1, FIG. 3 is a vertical sectional view on the line 3—3 of FIG. 2, FIG. 4 is a vertical sectional view on the line 4—4 of FIG. 2 on an enlarged scale and FIG. 5 is a sectional view on the line 5—5 of FIG. 4.

The stove cabinet or casing includes the base plate 20 which is oblong in shape and is made of cast or thick sheet metal. It is supported in a horizontal position above the floor by the four legs 21 one of which is at each corner. To the front edge of the base plate is preferably affixed a vertical edging 22 to retain ashes on the base or bottom plate.

Attached to the top side of the bottom plate as by welding is the three sided, vertical, outer shell portion made up of the sides 23 and 24 and the connecting front wall 25. The large opening 26 in this front wall provides access to the fire box so that wood or other fuel may be supplied for the fire. A strip edging 27 is preferably welded around the edge of the opening 26 to provide strength and to project slightly into a receiving channel of the door or doors to minimize leakage of combustion gases or smoke around the door.

The large front opening 26 is closed by the hinged doors 28 and 29 which slightly overlap, as in the usual practice, where they meet at the center; it is clear that a single large door may be used, which is hinged at one side of the opening. A latch should be provided in the conventional manner to serve to retain the doors in closed position.

Located within the outer shell 23, 24, 25 is the smaller upright three sided shell having the vertical sides 31 and 32 and the rear wall 33 all of which are welded to the base plate 20. The front edges of the side walls 31 and 32 fit against the front wall 25 and are welded to it to form a gas tight seal. The walls 31, 32, 33 of the inner shell are the same height as the walls 23, 24, 25 of the outer shell so that the top or cover plate 34 fits against them; it should be welded in place to prevent escape of gases. A back or rear plate 35 extends from the bottom plate 20 up to the cover plate 34 and from the side wall 23 to the other side wall 24.

The inner shell 31, 32, 33 forms the fire box and the usual grate indicated at 36 is supported in any convenient manner above a space which forms the ash pit. For instance, the grate can be supported in this position by lugs (not shown) on the inner sides of the walls 31, 32, 33 or by other support means. Preferably, a removable ash pan (not shown) fits in the ash pit below the grate.

It will be noted that there is a space between the side walls of the inner and outer shells and between the back plate and the rear wall of the inner shell. Thus, the wall 31 is spaced from the wall 23, the wall 32 is spaced from the wall 24 and the wall 33 is spaced from the back plate 35; as a consequence there is a U-shaped space or passageway around the rear and sides of the inner shell, and it is closed in at the bottom by the base plate 20 and is closed in at the top by the cover plate 34.

This U-shaped passageway is divided by a horizontal partition in a lower room air supply duct or chamber and an upper smoke and exhaust gas delivery duct or chamber. This dividing partition is made up of the side pieces 40 and 41 and the rear piece 42 and they can be of cast iron or heavy steel. Preferably, the rear piece 42 is an angle in cross section so that its rear vertical face will bear against the back plate 35 to form a tighter gas seal since this abutment cannot easily be welded together. These pieces can conveniently be welded at their edges where they contact the upright walls, to hold them in position.

The back plate 35 has two lower holes 44 and 45 (one large hole would suffice) through it at a level below the partition piece 42 for the inlet of room air. The walls of the inner shell also has holes through it below the horizontal partition and this places them below the grate. In the rear wall 33 is the hole 46, in the side wall 31 is the hole 47 and in the side wall 32 is the hole 48. Fresh air therefore, enters into the lower supply duct or chamber through the openings 44 and 45, sweeps through both sides of this chamber and enters into the space below the grate through the openings 46, 47, 48.

The back plate 35 additionally has the large, usually round flue hole 49 through it above the partition piece 42, and this hole 49 generally has a short cylindrical extension welded in place to receive the smoke pipe. The side walls 31 and 32 of the inner upright shell have at their tops the exit holes 50 and 51 respectively. Smoke from the fire box, therefore, exits from the fire box through these holes 50 and 51 into the upper exhaust gas delivery duct or chamber.

The hot combustion gases swirl around within this exhaust chamber above the horizontal partition and exits through the flue hole 49. In passing through this upper exhaust chamber the hot combustion gases play against the sides 23 and 24 of the outer shell and the back plate 35 as well as the top plate 34 and they become heated and radiate heat into the room. These heated surfaces cause hot convection air currents as well which circulate within the room or area being heated.

It has been stated above that an important feature of the invention is the provision of automatically functioning means for preventing or minimizing the escape of smoke from the stove into the room from the front opening when the front doors are opened. This feature involves the location of an auxiliary opening from the fire box directly to the flue so that when this opening is open, smoke does not have to go out through the side openings 50 and 51 and through the upper smoke chamber to reach the flue opening 49.

This auxiliary opening is shown at 81 in the rear wall 33 of the inner shell; it is preferably rectangular and is much wider horizontally than it is high and all or most of it should be opposite the flue hole 49 so that smoke goes through the opening 81 and directly into the flue hole 49. This places the opening 81 at the top part of the back wall 33 of the inner shell.

To close this opening 81 the closure plate 82 is provided and it is slightly less wide, horizontally, than the horizontal width of the opening so that its width fits within the opening 81. However, the closure plate 82 is higher vertically than the vertical height of the opening 81 so that even though it lies within the opening 81 it can almost fully close the opening. The top edge of the plate 82 lies within the fire box and its lower edge lies within the space between the rear wall 33 and the back plate 35.

To pivotally support the closure plate 82 in this oblique position within the opening 81 a horizontal pivot rod 83 is welded to the plate below its horizontal center line. This pivot or hinge rod 83 loosely rests in the hooks 84 and 85 which are on the rear side of the rear wall 33. They are best held in place just beyond the opening 81 by locating them and welding them in holes through the rear wall 33.

This manner of pivotal support has the advantage of low cost, it makes it easy to pass the closure plate through the opening 81 from the fire box and drop it in place and the pivot is free of a tendency to gum up. Also, because of this pivotal arrangement the closure plate 82 tends to fall of its own weight into the fire box and thus move the closure to its open position. The closure plate is therefore self biasing to its open position.

The operative connection between one of the front doors and the closure plate 82 includes the bushing 86 and the push rod or link 87. The bushing is welded to the upper part of the plate 82 so that its axis is horizontal and it is about midway of the width of the plate. One end, at 88, of the push rod 87 is pivotally mounted in the bushing 86 and is held therein by the cotter pin 89. The other end 91 passes through a hole 92 in the front wall 25 at a location where it will be struck and pushed upon by the door 28 (or 29) when the door is closed.

When the front door is open the weight of the closure plate 82 and the location of the pivot rod 83 causes the closure to fall to the position of FIG. 5. Its opening movement is limited as shown in FIG. 5 by a bend in the rod 87 which forms the shoulder at 93 that the top of the closure strikes against. As is shown in FIG. 4, the end portion 88 is at right angles to the portion 91 and they are connected by a S-curve of the rod to dispose the portion 91 generally in line with the center of the bushing 86, but this is not an essential relationship.

When the front door is closed it pushes on the link rod 87 and moves the closure plate 82 up to its closed position as is shown in FIGS. 2 and 4. The stove than assumes its normal smoke flow from the fire box, through the holes 50 and 51 into the smoke chamber above the horizontal partitions 40, 41, 42, and then out of the flue opening 49 and into the smoke stack. The auxiliary smoke opening 81 is eneffective as it is closed by plate 82.

The moment that the front door is opened the push rod 87 is released and the plate 82 falls to its open position so that smoke and combustion gases go immediately out of the opening 81 and directly to and through the flue hole 49. Because of this no smoke, or a minimal amount, comes out in the room through the front door opening 26.

If it is desired to further prevent smoke discharge into the room the stove may additionally be provided with the closure mechanism for the air inlet holes 44 and 45 which is disclosed and claimed in my application Ser. No. 178,093 mentioned above.

Modifications of the illustrated structure will be apparent and they are intended to come within the scope of the appended claims. For example there may be one large air inlet opening instead of the two shown at 44 and 45. The bushing 86 can advantageously be moved closer to the pivot rod 83 so that a short movement of the control rod 87 will exert a greater effect in moving the closure 82. If the bushing 86 is close to the pivot 83 the top of the closure may move two or three times the movement of the rod 87.

In addition to preventing the emission of smoke into the room the provision of the auxiliary opening 81 and its blocking closure 82 allows the side passageways 50 and 51 to be used for controlled flow devices. These may be polution control devices or heat efficiency exchangers, for instance, which would be used only when the door is closed and the draft can be regulated.

I claim:

1. A stove comprising a cabinet having spaced inner and outer walls providing a heating chamber between them and the inner wall providing therein an internal fire box, the outer wall having a front door opening and a rear flue outlet opening, a movable door for closing the front door opening, the inner wall having a main side opening remote from the flue opening so that combustion gases from the fire box must pass through the chamber to exit out of the flue opening, the inner wall also having a rear auxiliary opening directly opposite the flue opening so that combustion gases from the fire box can pass directly to the flue opening, a movable closure for the auxiliary opening which is biased by its own weight toward an open position, and operative connecting means including a pusher rod which is pivotally connected to the closure at one end and at its other end projects into the path of the front door whereby the closure is closed when the door is closed and the closure is open when the door is open, so that, thereby, combustion gases escape directly from the fire box through said auxiliary opening and directly to the flue and bypass said chamber.

* * * * *